US005196654A

United States Patent [19]

DiFlora et al.

[11] Patent Number: 5,196,654

[45] Date of Patent: Mar. 23, 1993

[54] COMPRESSOR DISCHARGE MUFFLER CONSTRUCTION

[75] Inventors: Michael A. DiFlora, Bristol, Tenn.; Gordon T. Boyd, Bristol, Va.

[73] Assignee: Bristol Compressors, Bristol, Va.

[21] Appl. No.: 672,207

[22] Filed: Mar. 19, 1991

[51] Int. Cl.[5] ..... F02M 35/00

[52] U.S. Cl. ..... 181/229; 181/255; 181/264; 181/403

[58] Field of Search ..... 181/229, 238, 240, 264, 181/403, 255, 272

[56] References Cited

U.S. PATENT DOCUMENTS 2,513,229 6/1950 Bourne et al. ..... 181/264
2,562,101 7/1951 Hoyle ..... 181/255
4,111,278 7/1978 Bergman ..... 181/229
4,192,404 3/1980 Nakagawa et al. ..... 181/272
4,341,284 7/1982 Moore et al. ..... 181/272

*Primary Examiner*—Michael L. Gellner
*Assistant Examiner*—Khanh Dang

[57] ABSTRACT

A discharge muffler construction having a casing which defines a noise attenuation cavity and which is provided with an inlet and outlet located at substantially opposite portions thereof and communicating with the cavity, a baffle plate in the cavity intermediate the inlet and outlet and partitioning the same into at least two chambers, the baffle plate having an arcuate surface concave to the inlet, an aperture through the baffle plate, and a tubular conduit mounted through the aperture and placing the chambers in fluid communication.

23 Claims, 1 Drawing Sheet

COMPRESSOR DISCHARGE MUFFLER CONSTRUCTION

FIELD OF THE INVENTION

The present invention relates to mufflers or sound attenuation devices and particularly to discharge mufflers for hermetically sealed gas compressors used in refrigerators, heat pumps, window air conditioning units, or other such applications, all such applications hereinafter referred to as refrigeration systems.

DESCRIPTION OF RELATED ART

Typically, discharge mufflers for hermetically sealed gas compressors are generally characterized by a casing or shell divided into roughly equal volume chambers by a baffle plate or partition wall, and having a restriction tube passing through the baffle plate from one chamber to the other and placing the chambers in fluid communication. This type of compressor muffler is disclosed in a number of U.S. Patents. Bergman, U.S. Pat. No. 4,111,278 discloses a sheet metal, discharge muffler having a substantially flat baffle plate and a restrictor tube having a flared entrance portion and a venturi-like restriction intermediate its ends. Gannaway, U.S. Pat. No. 4,330,239 discloses a compartmentalized muffler having a flat partition wall through which a restrictor tube passes., Hald, U.S. Pat. No. 3,171,506 discloses a sheet metal muffler formed from a plurality of "⊔" therefrom is substantially flat. Steenstrup, U.S. Pat. No. 2,133,876 discloses an intake muffler for a refrigerator compressor, formed from a number of cannister-like, casing section having a partition therebetween formed by either the top portion of the lower casing or a separate partition member.

A major problem in the performance of the above type of muffler has been the structural integrity and longevity of its baffle plates. Prior such mufflers typically have employed baffle plates of substantially flat configuration. Such configuration has bene identified as a major cause of plate failure due to their tendency to flex and vibrate somewhat in the manner of a drumhead, and also due to their inherent lack of resistance to blow-through, i.e., actual rupture of the metal. At this point it should not be noted that such discharge mufflers typically are subjected to gas or liquid (hydrostatic) pressures of over 1000 psi, often up to about 1500 psi, such as might occur during cold start-up of a refrigeration system. Thus, the ostensibly exaggerated thickness dimensions of the steel parts as shown in the drawing are actually typical of these mufflers. The flat configuration also engenders excessive vibration through its inherent lack of dispersion capability of gas or liquid entering the muffler inlet chamber, in that the primary force vectors directed against the flat baffler plate are essentially normal thereto, as are the rebound and reinforcing waves, causing increased noise levels and higher resistance to gas or liquid flow into the inlet chamber.

It is, therefore, a principal object of the present invention to provide an improved discharge muffler for a gas compressor, providing enhanced sound attenuation and markedly increased structural integrity and muffler longevity.

SUMMARY OF THE INVENTION

The above and other objects hereinafter becoming evident have been attained in accordance with the present invention through the discovery of compressor discharge muffler construction comprising casing means which defines noise attenuation cavity means, and which is provided with inlet and outlet means located at substantially opposite portions of said casing means and communicating with said cavity means, baffle plate means mounted in said cavity means and positioned intermediate said inlet and outlet means, and partitioning the same into at least two chamber means, said baffle plate means having arcuate surface means generally facing concave to said inlet means, aperture means through said plate means, and tubular conduit means mounted through said aperture means and placing said chambers in fluid communication.

In certain preferred embodiments:

(1) the flow axis of said conduit means is offset laterally in said cavity means from the flow axis of said inlet means;

(2) the flow axis of said outlet means is generally perpendicular to the flow axis of said conduit means;

(3) said arcuate surface is part of a substantially hemispherical surface having a radius of from about 1.0 to about 4.0 inches, preferably from about 1.5 to about 2.5 inches, and most preferably from about 1.9 to about 2.3 inches; and (4) said baffle plate means is generally rectangular in elevation and formed with side wall means depending generally normally from the concave side of said substantially hemispherical surface.

Further advantages, objects and features of the present invention will become apparent from the following description, claims and accompanying drawings.

DESCRIPTION OF PREFERRED EMBODIMENTS

Figure 2:
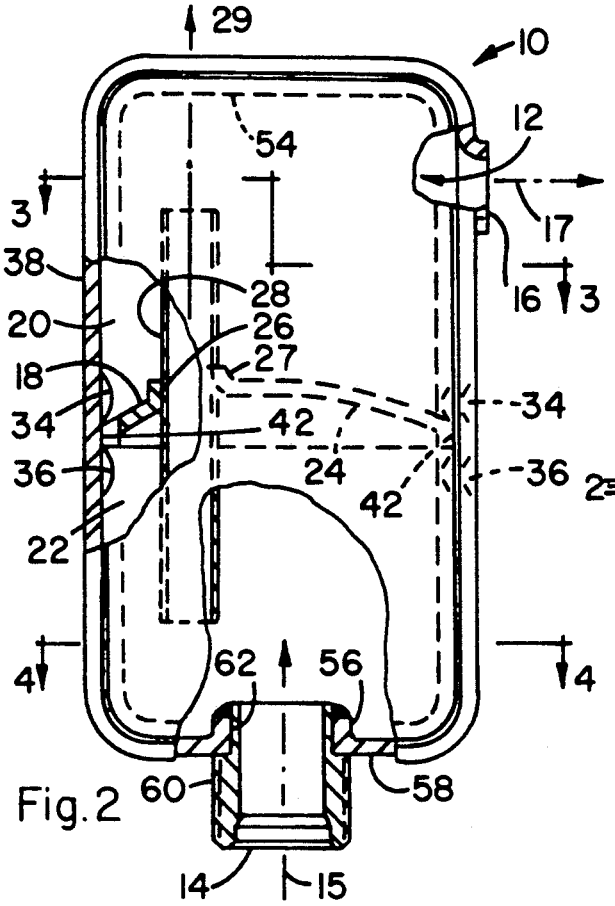
FIG. 2 is a partially sectional view taken in the direction of arrow 2 in FIG. 1.
Figure 1:
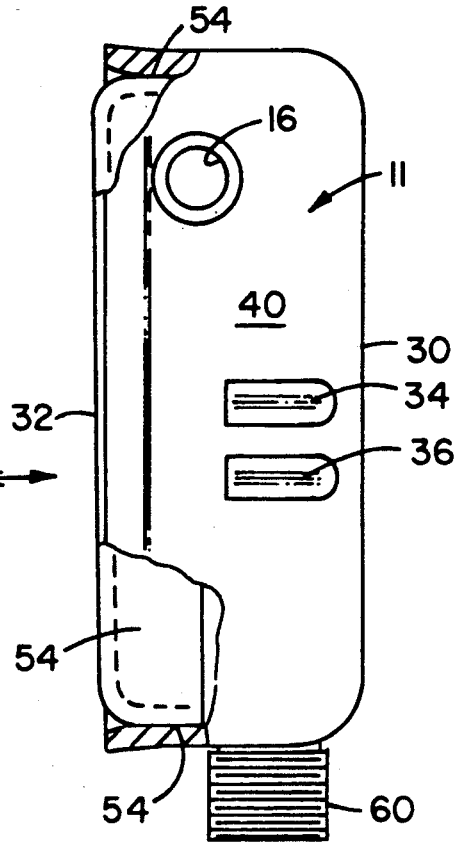
FIG. 1 is a side elevational view, with portions of the casing wall broken away for clarity, of a discharge muffler constructed in accordance with the present invention.
Figure 3:
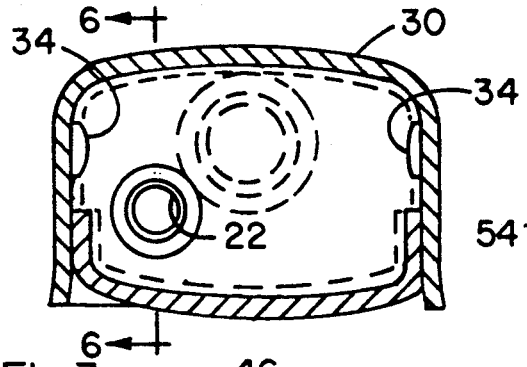
FIG. 3 is a sectional view taken substantially along line 3—3 in FIG. 2.
Figure 4:
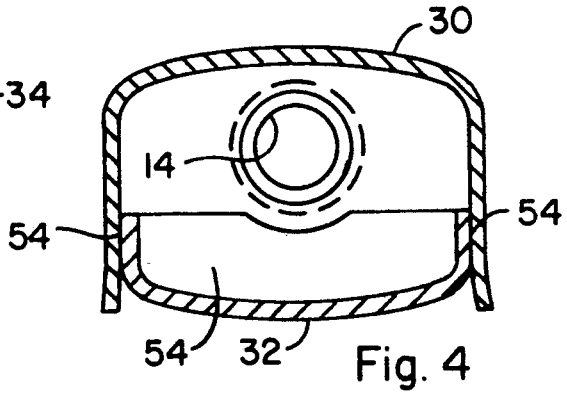
FIG. 4 is a sectional view taken substantially along line 4—4 in FIG. 2.
Figure 5:
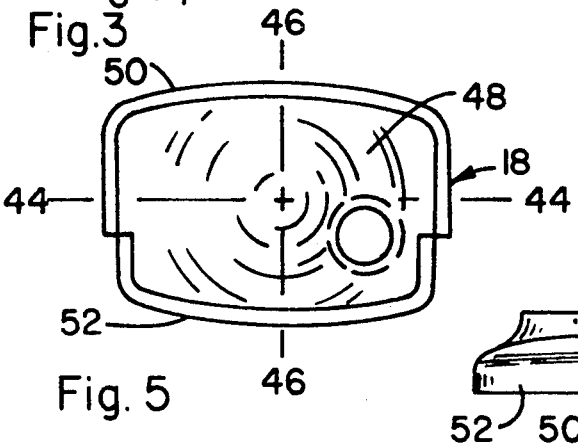
FIG. 5 is a bottom view of the baffle plate.
Figure 6:
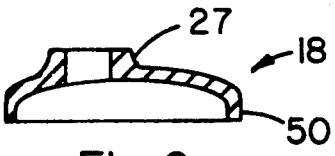
FIG. 6 is a sectional view of the baffle plate taken along line 6—6 of FIG. 3 in the direction of the arrows.
Figure 7:
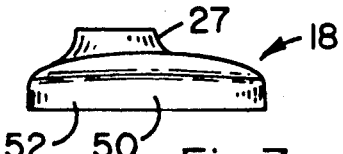
FIG. 7 is a side elevational view of the baffle plate.

Referring now to the drawing where like numerals refer to like and corresponding parts throughout the several views, and to the claims hereof, there is shown a discharge muffler 10, preferably of steel construction and comprising casing means 11 which defines noise attenuation cavity means generally designated 12, and which is provided with inlet means 14 adapted for connection to a compressor discharge port and having the flow axis 15, and with outlet means 16 adapted for connection to the high pressure condenser line of a refrigeration system and having the flow axis 17, the inlet and outlet means being located at substantially opposite portions of the casing means and communicating with the cavity means 12, baffle plate means 18 mounted within the cavity means and partitioning the same into at least two chamber means 20 and 22, the baffler plate means having arcuate surface means 24 concave to the inlet means, aperture means 26 through the plate means, and tubular conduit means 28 mounted through the aperture means and placing the chamber means 20 and 22 in fluid communication.

More particularly, the casing means comprises front and back sections, 30 and 32 respectively, which are slidably, frictionally nested together during manufacture. Section 30 is provided with indentation pairs 34 and 36 on each casing side 38 and 40 thereof, which form a guide slot 42 on the inside of each side 38 and 40. These slots slidably, frictionally receive and hold baffle plate 18 in precisely the desired location during assembly of the muffler parts.

Baffle plate 18 has an arcuate configuration along at least one of its major or minor axes 44 or 46 respectively, and preferably along both axes to form a substantially hemispherical surface 48. As indicated above, such surface should have a contour which gives the required strength and other aforementioned functional characteristics, and such has been found to reside in the radii stated above. This arcuate or hemispherical type surface possesses greatly increased anti-rupture strength, and markedly reduces gas noise, possibly through rebound wave interference or disruption.

In manufacturing the present muffler, the baffle plate is properly shaped, e.g., by metal stamping and forming, and provided with peripheral side wall means generally designated 50, and with aperture 26. Restrictor tube 28 having flow axis 29 is inserted through 26 and affixed in any suitable manner to aperture boss 27 formed on the plate. Plate 18 is then inserted in slots 42, preferably tightly, and back section 32 of the casing tightly nested within front section 30 and bearing against the back wall portion 52 of the plate.

It is preferred in the manufacture, that substantial surface areas of baffle wall means 50 and of peripheral wall means 54 of back section 32 be provided such that these areas can be coated with a brazing composition, flux or the like, and the casing and baffle plate tightly, frictionally assembled and thereafter joined into an exceptionally strong unit in a brazing furnace. Tube 28 is preferably also secured in this manner to boss 27, in the same brazing operation. The brazing composition or alloy such as Cu/Zn, may, of course, be widely varied, however, it preferably consists of essentially 100% copper, and the brazing is done at above about 2,000° F.

The inlet means 14 is provided by boss 56 press formed into the end portion 58 of casing section 30, and threaded nipple 60 tightly inserted through the boss aperture 62. This nipple is also preferably brazed into the unit in the above brazing operation.

In operation, the high pressure refrigerant gas, liquid, or gas-liquid mixture is pressured through inlet 14 into inlet chamber 22 and principally against surface 24 of baffle plate 18. The hemispherical contour of this surface directs rebounding refrigerant in a mixed directional pattern incapable of generating or sustaining true wave patterns or wave reinforcement. The refrigerant exits chamber 22 through conduit 28 and emerges into outlet chamber 20 and hence through outlet 16 to the high pressure side of the condenser.

This invention has been described in detail with particular reference to preferred embodiments thereof, but it will be understood that variations and modification will be effected within the spirit and scope of the invention.

I claim:

1. A gas compressor discharge muffler comprising casing means defining noise attenuation cavity means, inlet means and outlet means located at substantially opposite portions of said casing means and communicating with said cavity means, each of said inlet and outlet means having a flow axis, baffle plate means having an inlet side and an outlet side and positioned in said cavity means intermediate said inlet and outlet means and partitioning said cavity means into inlet and outlet chamber means, said inlet side of said plate means having concave arcuate surface means oriented generally normally to said flow axis of said inlet means and formed substantially on a radius of from about 1.0 to about 4.0 inches, and conduit means formed through said plate means and placing said inlet and outlet chamber means in fluid communication with each other.

2. The muffler of claim 1 wherein said conduit means is elongated and has a flow axis offset laterally in said cavity means from said flow axis of said inlet means.

3. The muffler of claim 2 wherein said flow axis of said outlet means is oriented generally normally to the flow axis of said conduit means.

4. The muffler of claim 1 wherein said cavity means is substantially rectangular and said plate means divides said cavity means into two chambers of substantially equal volumes.

5. The muffler of claim 4 wherein said surface means is generally rectangular having a major longitudinal dimension and a minor lateral dimension and is arched along said major longitudinal dimension.

6. The muffler of claim 1 wherein said plate means is generally rectangular in elevation and provided with peripheral portions, said peripheral portions comprising side wall means and end wall means depending generally from the inlet side of said plate means into said inlet chamber means.

7. The muffler of claim 1 wherein said arcuate surface means is substantially hemispherically contoured.

8. The muffler of claim 7 wherein said contour is substantially on a radius of from about 1.0 to about 4.0 inches.

9. The muffler of claim 7 wherein said contour is substantially on a radius of from about 1.5 to about 2.5 inches.

10. The muffler of claim 7 wherein said contour is substantially on a radius of from about 1.9 to about 2.3 inches.

11. A gas compressor discharge muffler comprising casing means defining noise attenuation cavity means, inlet aperture means and outlet aperture means through said casing means at spaced locations thereon and communicating with said cavity means, each of said aperture means having a flow axis, baffle plate means mounted in said cavity means intermediate said inlet and outlet means and having an inlet side and an outlet side and partitioning said cavity means into an inlet chamber and an outlet chamber, said inlet side of said plate means having an arcuate surface generally facing toward said inlet aperture means and formed on a radius of from about 1.0 to about 4.0 inches, and tubular conduit means mounted through said plate means and placing said inlet and outlet chambers in fluid communication with each other.

12. The muffler of claim 11 wherein said conduit means has an inlet port offset laterally in said cavity means from said inlet aperture means.

13. The muffler of claim 11 wherein generally opposite inner side wall portions of said casing means are each provided with slot means in which said plate means is mounted.

14. The muffler of claim 13 wherein said casing means is generally rectangular and comprises two sections of generally cupped configuration, each said section having major wall means of generally planar configuration, and further having side wall means and end wall means integral with the periphery of said major wall means and extending generally normally from the plane thereof, said sections being dimensioned to allow portions of the side wall means and end wall means of one section to be forcibly slid within the side wall means and end wall means of the other section, and the opposed side wall means of one of which sections is provided with said slot means.

15. The muffler of claim 13 wherein said plate means is generally rectangular in elevation and formed with side wall means depending therefrom, and wherein generally opposite portions of said side wall means of said plate means are mounted in said slot means.

16. The muffler of claim 15 wherein said arcuate surface means is hemispherically contoured.

17. The muffler of claim 16 wherein the contour is substantially on a radius of from about 1.0 to about 4.0 inches.

18. The muffler of claim 16 wherein the contour is substantially on a radius of from about 1.9 to about 2.3 inches.

19. A gas compressor discharge muffler comprising casing means defining noise attenuation cavity means, said casing means being comprised of two generally cup-shaped section each of which has a major wall means and side wall means and end wall means integral with peripheral portions of said major wall means and extending generally outwardly therefrom, portions of the side wall means and end wall means of one section being tightly nested and secured within a portion of the side wall means and end wall means of the other section, and inlet aperture means and outlet aperture means through said casing means at spaced locations thereon and communicating with said cavity means, baffle plate means mounted in said cavity means intermediate said inlet and outlet means and having an inlet side and an outlet side and partitioning said cavity means into an inlet chamber and outlet chamber, said inlet side of said plate means having concave arcuate surface means generally facing toward said inlet aperture means, substantially on a radius of from about 1.0 to about 4.0 inches and tubular conduit means mounted through said plate means and placing said inlet and outlet chambers in fluid communication with each other, said conduit means having inlet port means laterally offset from said inlet aperture means, and having outlet port means laterally offset from said outlet aperture means.

20. The muffler of claim 19 wherein each said major wall means is substantially planar and each said side wall means and end wall means of each section extend generally normally from the plane of each said major wall means.

21. The muffler of claim 19 wherein said conduit means extends at least about one half the way through each of said inlet and outlet chambers.

22. The muffler of claim 1 wherein said casing means comprises two generally cup-shaped sections, each section comprising substantially planar major wall means having peripheral portions and side wall means and end wall means integral with said peripheral portions and extending generally normally from the plane of the section, said sections being dimensioned to allow portions of the side wall means and end wall means of one section to be forcibly, frictionally slide within the side wall means and end wall means of the other section.

23. The muffler of any one of claims 6, 14, 15, 19, 20 or 22 comprised of steel and wherein said sections of said casing means are copper-brazed together.

* * * * *